United States Patent [19]

Papalos

[11] 3,936,268

[45] Feb. 3, 1976

[54] METHOD OF REDUCING BARRÉ IN SYNTHETIC POLYMIDE TEXTILES DYED WITH ACID DYES

[75] Inventor: John G. Papalos, Ledgewood, N.J.

[73] Assignee: Diamond Shamrock Corporation, Cleveland, Ohio

[22] Filed: Nov. 7, 1974

[21] Appl. No.: 521,548

[52] U.S. Cl. ..... 8/173; 8/89; 8/178 R

[51] Int. Cl.[2] ..... D06P 1/84

[58] Field of Search ..... 8/89, 173, 178 R

[56] References Cited

UNITED STATES PATENTS

| | | | |
|---|---|---|---|
| 2,572,954 | 10/1951 | Schwartz | 8/89 |
| 3,118,723 | 1/1964 | Harding | 8/173 |
| 3,377,130 | 4/1968 | Millson et al. | 8/89 |
| 3,619,123 | 11/1971 | Walz et al. | 8/89 |
| 3,690,815 | 9/1972 | Dellian | 8/173 |
| 3,765,839 | 10/1973 | Mueller et al. | 8/174 |
| 3,844,712 | 10/1974 | Frickenhaus et al. | 8/173 |

*Primary Examiner*—V. P. Hoke

*Attorney, Agent, or Firm*—Neal T. Levin; Theodore J. Dettling

[57] ABSTRACT

In dyeing nylon textiles with acid dyes, barré is reduced by using a synergistic mixture of a dye-leveling alkyl sulfonate and a dye-leveling alkyl aryl sulfonate.

5 Claims, No Drawings

METHOD OF REDUCING BARRÉ IN SYNTHETIC POLYMIDE TEXTILES DYED WITH ACID DYES

BACKGROUND OF THE INVENTION

This invention relates generally to a method of reducing barré in synthetic polyamide textiles dyed with acid dyes. More particularly it relates to a method of dyeing synthetic polyamide textiles with acid dyes using as the principal dye leveler a synergistic mixture of a particular alkyl sulfonate surfactant and a particular alkyl aryl sulfonate surfactant.

In dyeing synthetic polyamide textiles such as fibers, fabrics or garments (hereafter collectively called "nylon" or "nylon textiles") with acid dyes, there often is obtained barré or streakiness in the dyed textile due to inherent physical and/or chemical differences existing in the yarns from which the textile has been made. For further information about the causes and manifestations of barré reference is made to U.S. Pat. No. 3,619,122 and *American Dyestuff Reporter*, Feb. 12, 1968, pgs. 42–47.

To prevent or minimize barré to an acceptable degree, a variety of anionic surfactants have been employed as dyeing levelers in the dyeing of nylon textiles with acid dyes. One of the earliest class of anionic surfactants used were the mixed fatty alcohol sodium sulfates. Subsequently, alkyl sulfonate and alkyl diaryl sulfonate type surfactants were recommended. In recent times, more complex and costly anionics have been alleged in patents to prevent barré; e.g. sulfonated sulphones derived from a variety hydroxy-substituted aryl compounds in U.S. Pat. No. 3,536,438, dialkyl sulfosuccinates in U.S. Pat. No. 3,619,122, and alkane- or alkene-amido-benzene-sulphonics in U.S. Pat. No. 3,713,768.

In spite of the abundance of work done to identify anionic surfactants capable of minimizing or preventing barré, a need still exists for improved dyed levelers considering the great number of different acid dyes employed, the fact that they are typically used in combinations, and the variety of nylons textiles being dyed. In many instances less than satisfactory barré effects are tolerated because a dye leveler suitable from both an economic and a performance standpoint is unavailable.

SUMMARY OF THE INVENTION

Considering this state of art, it is an object of the present invention to provide a unique combination of dye levelers that is both economical and effective in minimizing or preventing barré effects in the dyeing of a variety of nylon textiles with different acid dyes.

This object and other objects and advantages, which will become apparent from the following description and examples, are achieved by dyeing nylon textiles with acid dyes in the presence of a synergistic combination of anionic surfactants consisting essentially of a dye-leveling alkyl sulfonate and a dye-leveling alkyl aryl sulfonate.

DESCRIPTION OF PREFERRED EMBODIMENTS

The nylon textiles that can be dyed in accordance with the invention can be in the form of fibers (either staple or continuous), fabrics (woven, nonwoven, knitted and the like), or finished textiles goods. Further the nylon textiles can be composed essentially 100% of a synthetic polyamide, or may be blended with other types of textile materials, such as polyesters, polyacrylonitriles, wool, cotton, and the like, care being taken that any other textile materials utilized be compatible with the dyes and the dyeing conditions used for the nylon.

Acid dyes suitable for the invention process can, generally, be any of those normally used for dyeing nylon, as for example, those belonging to the azo, anthraquinone, quinophthalone, phthalocyanine or triphenylmethane classes of dyes or the nitro or formazane dyestuffs, which optionally may contain complex-bound metals, such as copper, nickel, chromium or cobalt.

The alkyl sulfonate employed in the invention process may be any sodium, potassium, ammonium, or water-soluble amine (monoethyl amine, diethyl amine, and the like) salt of an alkyl sulfonic acid that is soluble in the dye bath at the concentration and conditions of use and contains an average of about 8 to 20 carbon atoms. Sometimes mixtures of two or more alkyl sulfonates are advantageously employed. The alkyl sulfonate may be straight chained or branched, normally contains a mixture of alkyl groups having differing carbon atom totals, and may contain unreacted reactants and reaction by-products. Further, when manufactured from alphaolefins by a synthesis method comprising sulfonation and hydrolysis, up to about 60% weight percent of the alkane groups may be hydroxy alkane moieties as shown, for example, in the U.S. Pat. Nos. 3,332,876 and 3,506,580. Other methods for producing alkyl sulfonates useful in the invention include, inter alia, the reaction of bisulfites with olefins, as shown, for example in U.S. Pat. Nos. 2,318,036, 3,084,186 and 3,336,210, and the reaction of a saturated hydrocarbon with $SO_2$ and $Cl_2$ to form an alkylsulfonyl chloride which is hydrolyzed to the corresponding sulfonic acid (Reed Process). Because of lower costs and ready availability, typically, alkyl sulfonates having an average of about 12 to 16 carbon atoms are preferred and will normally be used.

The second component of the dye leveler combination employed in the invention process, the alkyl aryl sulfonate, is a sodium, potassium, ammonium or water-soluble amine salt of an alkyl sulfonic acid represented by the general formula:

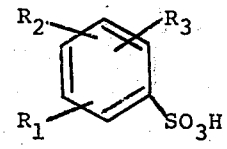

where:

$R_1$ = hydrogen or a methyl group $R_2$ = hydrogen or an alkyl group having 1 to 4 carbon atoms $R_3$ = an alkyl group having an average of 8–20 carbon atoms, which salt is soluble in the dye bath at the concentration and conditions of use. While normally only one alkyl aryl sulfonate will be used, there may be instances where mixture of two or more will achieve best results. Alkyl aryl sulfonates of the above description and methods for their synthesis are, of course, well known. Thus, as known, $R_2$ and $R_3$ may be linear or branched, and the 8 to 20 carbon atoms in $R_3$ alkyl group represents an average number, and the surfactant can contain unreacted reactants and reaction by-products. In this connection, the quantity of active sulfonate in the alkyl aryl sulfonate is not narrowly critical and up to as much as 50 weight percent of the alkyl aryl sulfonate may be comprised of unsulfonated alkyl aryl precursor and still be used in the invention process. Because of their lower cost and availability, alkyl aryl sulfonates derived from benzene, toluol and xylol and having an alkyl group of about 12 to 16 atoms, average, typically will be used.

In the invention process, weight ratios (on a solids basis) of the alkyl sulfonate to alkyl aryl sulfonate of 9:1 to 1:9 can be used with benefit in dyeing nylon textiles with acid dyes. However, narrower ratios, such as 3:1 to 1:3 exhibit even less barré and are more preferred. Maximum synergism is obtained when weight ratios ranging from 3:2 to 2:3 are employed and, hence, constitute the most preferred invention embodiments.

The quantity of alkyl sulfonate and alkyl aryl sulfonate typically employed in the invention process will be the minimum necessary to achieve an acceptably uniform dyed appearance (barré-reducing quantity). Generally, depending on a number of interrelated factors, such as type of nylon, type and color intensity of the dye, dyeing conditions, and the like, acceptable minimization of barré will be achieved when from about 0.25 to 4.0 parts by weight of the invention combination of sulfonates is used per 100 parts by weight of the nylon textile being dyed. In most cases 0.5 to 1.0 parts will be optimum from a cost/performance standpoint. While the above ratios are expressed on a solids basis it will be appreciated by those in the art that the sulfonates employed in the invention process are often marketed and thus will be used as aqueous solutions containing typically 25 to 75% total solids. Additionally, while the combination of sulfonates often will be preblended before addition to the dye bath as a matter of convenience, this is not critical and they can, if desired, be added separately as further discussed hereinafter.

It is within the scope of the present invention to use other types of anionic surfactants in conjunction with the invention dye-leveler sulfonate mixture when this might be desirable to facilitate dyeing or to achieve special dyed effects. Normally, if used, such other anionics will constitute a minor proportion of the total dye levelers used.

In all other respects, the invention dyeing process is generally conventional. Thus, as with most dye levelers, the invention combination of sulfonates normally is most effectively utilized when added either separately or premixed together to the dye bath containing the nylon textile prior to the addition of the acid dye, and then preconditioning the textile for some finite period such as 5 to 30 minutes. Alternatively, one of the sulfonates can be added during preconditioning and the other added at or about the same time as the dye. In other instances, equally good results can be achieved by adding both concurrently (either separately or premixed) with the dye, or even at some time appreciably thereafter.

The temperature normally employed can vary from 40° to 120°C, with 60° to 100°C being typical. When a preconditioning step for the textile is utilized, temperatures of about 25°–60°C will often first be used, followed by a higher temperature such as 80°–120°C after dye addition. Usual pH's of aqueous acid dye baths are from about 6 to 8. After dyeing the pH may be lowered to about 4.0 or less to more completely exhaust the dye and to impart better wash fastness to the dyed textile. To control the pH of the dye bath, compounds such as acetic acid, formic acid, dilute sulfuric or phosphoric acid, ammonium sulfate, sodium acetate and the like are used. Other materials often used in acid dye baths include: nonionic surfactants to improve fabric wetting or control the degree of dye dispersion; organic water-miscible solvents, such as isopropanol, to predisperse the acid dyes or assist in fabric wetting; and chelating agent, such as ethylenediamine tetra-acetic acid, to tie up iron and other polyvalent metal ions that can adversely effect the dyeing process or product quality. After dyeing, the nylon textile is normally washed with water before being dried.

EXAMPLES

Nine nylon knit test swatches (Prepared from Banlon/Helanca fibers supplied by Test Fabrics Inc., Middlesex, N.J.) were dyed using the dye levelers delineated in the table according to the following procedure.

For each test a 400 ml beaker was charged with:

150 mls water, 10 mls of 1.0% aqueous ammonium sulfate, 10 mls of 0.125% aqueous ethylenediamine tetra-acetic acid, 0.05 gm on a solids basis of the dye lever shown in the table, and the charged ingredients were stirred and heated to 50°C.

A 5 gm swatch of the test nylon knit was next added to each beaker and periodically stirred for 15 minutes at 50°C. There was then added to each beaker 5 mls of a dye mix (0.005 g solids; solvent — 50/50 by volume ratio of water and isopropanol) consisting of in parts by weight:

15-Rubine N5BL* (Acid Red-229)

2-Nylosan Yellow* (Acid Yellow-159)

8-Nylosan Blue NBLF* (Color index number unknown)

(* Trademarks for dyes supplied by Sandoz Color & Chemicals)

and the beaker contents heated to boiling and periodically stirred for 1 hour. The pH of the dye bath during dyeing was 6.3 The pH of the dye bath was then lowered to about 4 by adding dropwise 5 ml of 10% aqueous acetic acid over a 15 minute period while continuing periodic stirring of the bath. After cooling the bath to 60°C, again with periodic stirring, the dyed test swatch was removed, rinsed with cold running water, and dried at room temperature.

Each of the nine test swatches were then visually examined and rated for barré. Five different levels of dye uniformity were discernible and were arbitrarily assigned ratings of A,B,C,D & E, with rating A being the best (hardly discernible barré and uniform dyeing) and E worst (barré quite visible with blotchy color). Ratings B,C,D, on the other hand identified test swatches which, while uniform in dye levelness, exhibited increasing discernible barré.

EFFECT OF DIFFERENT ANIONIC DYE LEVELERS ON BARRÉ

| EXAMPLE | DYE LEVELING AGENT[1] | BARRÉ RATING |
|---|---|---|
| 1 | Control[2] | E |
| 2 | 100% -dodecylbenzene sodium sulfonate[3] | D |
| 3 | 100% BIO TERGE AS-35CL.[4] | D |
| 4 | 90% dodecylbenzene sodium sulfonate<br>10% BIO TERGE AS-35CL | C |
| 5 | 90% BIO TERGE AS-35CL<br>10% dodecylbenzene sodium sulfonate | C |

-continued

EFFECT OF DIFFERENT ANIONIC DYE LEVELERS ON BARRÉ

| EXAMPLE | DYE LEVELING AGENT[1] | BARRÉ RATING |
|---|---|---|
| 6 | 75% dodecylbenzene sodium sulfonate<br>25% BIO TERGE AS-35CL | B |
| 7 | 75% BIO TERGE AS-35CL<br>25% dodecylbenzene sodium sulfonate | B |
| 8 | 50% dodecylbenzene sodium sulfonate<br>50% BIO TERGE AS-35CL | A |
| 9 | 50% dodecylbenzene sodium sulfonate<br>50% sodium C-14 alpha-olefin sulfonate [5] | A |

FOOTNOTES

[1]Percentages are by weight and on a solids basis for all the sulfonates.

[2]No dye leveling agent used.

[3]Dodecyl is the average alkyl length. Added as a 33% aqueous solution having a pH of 9.5. Surfactant contained 1 part dodecylbenzene per 3 parts dodecylbenzene sulfonate.

[4]Trademark of Stepan Chemical Company for a sodium alpha-olefin sulfonate having an average of about 14 carbon atoms, a total of 42%, an activity of 35%, and a pH (1% solution) of 7.6. Added as received.

[5]Produced by the method of Example 1 of British Patent 1,291,267. Solids had 26%-$SO_3$ and no detectible olefin oil. Added as 33% aqueous solution having a pH of 6.5.

From the results tabulated in the table, it is apparent that the substitution of as little as 10 weight percent of an alkyl sulfonate or an alkyl aryl sulfonate for the other reduces barré in nylon textiles dyed with acid dyes, and that the anti-barré effect of the dye leveler mixture is maximized when about equal amounts of each is used. Additionally, essentially complete exhaustion of the dye mix was obtained with the sulfonate mixtures.

From the foregoing description and examples, it can be seen the present invention provides a new dye leveler system of enhanced effectiveness for preventing or minimizing barré in nylon textiles dyed with acid dyes. Further it can be seen that this improvement is obtained without any appreciable concomitant increase in cost, since the invention dye leveler system utilizes commercially available low-cost anionic surfactants.

What is claimed is:

1. In a process of dyeing a nylon textile with an acid dye, the improvement which comprises:

dyeing the nylon textile in the presence of a barré-reducing quantity of a combination of anionic surfactants consisting essentially of A. A dye-leveling alkyl sulfonate, and B. a dye-leveling alkyl aryl sulfonate, to obtain a dyed nylon textile having less barré than if similarly dyed in the presence of an equivalent amount of of either (A) or (B) alone;

the quantity of the combination of the anionic surfactants being about 0.25 to 4.0 parts by weight per 100 parts by weight of the nylon textile;

the weight ratio of the alkyl sulfonate to the alkyl aryl sulfonate being within the range of 1:9 to 9:1;

the alkyl sulfonate being a sodium, potassium, ammonium or water-soluble amine salt of an alkyl sulfonic acid having 8 to 20 carbon atoms; and the alkyl aryl sulfonate being a sodium, potassium, ammonium, or water-soluble amine salt of an alkyl aryl sulfonic acid having the general formula:

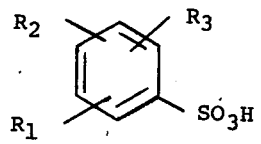

where, $R_1$ is hydrogen or a methyl group, $R_2$ is hydrogen or an alkyl group having 1 to 4 carbon atoms, and $R_3$ is an alkyl group having 8 to 20 carbon atoms.

2. The process of claim 1 wherein the alkyl sulfonic acid has an average of about 12 to 16 carbons atoms and the alkyl aryl sulfonic acid is an alkylbenzene sulfonic acid in which the alkyl group has an average of about 12 to 16 carbon atoms.

3. The process of claim 2 wherein the alkyl sufonate and the alkyl aryl sulfonate are used in a ratio of 2:3 to 3:2.

4. The process of claim 1 wherein the alkyl sulfonate is a sodium alkyl sulfonate having an average of about 14 carbon atoms and the alkyl aryl sulfonate is a sodium alkylbenzene sulfonate in which the alkyl group has an average of about 12 carbon atoms.

5. The process of claim 4 wherein the ratio of the sodium alkyl sulfonate to the sodium alkyl benzene sulfonate is 3:2 to 2:3.

* * * * *